US005162185A

United States Patent [19]

Fukuda et al.

[11] Patent Number: 5,162,185

[45] Date of Patent: Nov. 10, 1992

[54] ELECTROPHOTOGRAPHIC PHOTORECEPTOR AND PROCESS FOR PRODUCING THE SAME

[75] Inventors: Yuzuru Fukuda; Shigeru Yagi, both of Kanagawa, Japan

[73] Assignee: Fuji Xerox Co., Ltd., Tokyo, Japan

[21] Appl. No.: 584,610

[22] Filed: Sep. 19, 1990

[30] Foreign Application Priority Data

Sep. 25, 1989 [JP] Japan ..... 1-246499

[51] Int. Cl.[5] ..... G03G 5/14

[52] U.S. Cl. ..... 430/60; 430/65; 430/131

[58] Field of Search ..... 430/60, 65, 131

[56] References Cited

U.S. PATENT DOCUMENTS

| | | | |
|---|---|---|---|
| 3,615,405 | 10/1971 | Shebanow | 430/65 X |
| 4,369,242 | 1/1983 | Arimilli et al. | 430/58 |
| 4,403,026 | 9/1983 | Shimizu et al. | 430/65 |
| 4,416,962 | 11/1983 | Shirai et al. | 430/65 |
| 4,782,000 | 11/1988 | Lauke et al. | 430/131 X |
| 4,800,144 | 1/1989 | Ueda et al. | 430/65 X |
| 4,933,255 | 6/1990 | Hata et al. | 430/131 |

FOREIGN PATENT DOCUMENTS

| | | | |
|---|---|---|---|
| 158 | 1/1984 | Japan | 430/60 |

OTHER PUBLICATIONS

H. Takahashi, et al., Anodizing of Aluminum Covered with Hydroxide I. Formation of Hydroxide and Composite Oxide Films, vol. 38, No. 2, pp. 31-37 (1987).

*Primary Examiner*—Roland Martin

*Attorney, Agent, or Firm*—Finnegan, Henderson, Farabow, Garrett and Dunner

[57] ABSTRACT

An electrophotographic photoreceptor is disclosed, comprising a substrate having thereon a light-reflection preventing layer comprising an anodized aluminum film and a photosensitive layer in this order. And the electrophotographic photoreceptor can be produced by a process comprising subjecting a substrate at least a surface of which comprises aluminum or an aluminum alloy to anodic oxidation in a neutral aqueous solution containing at least one of boric acid, boric acid salt, a phosphoric acid salt, etc. in a concentration of from 1 to 30% by weight or an acidic aqueous solution containing at least one of sulfuric acid, phosphoric acid, oxalic acid, chromic acid, etc. in a concentration of from 1 to 30% by weight to form an anodized aluminum film as a light reflection-preventing layer on the substrate, and then forming a photosensitive layer on said anodized aluminum film. The anodized aluminum film prevents appearance of an interference fringe when the photoreceptor is applied to a laser beam printer.

9 Claims, 1 Drawing Sheet

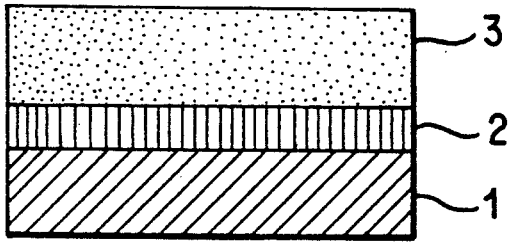
3
2
1

ELECTROPHOTOGRAPHIC PHOTORECEPTOR AND PROCESS FOR PRODUCING THE SAME

FIELD OF THE INVENTION

This invention relates to an electrophotographic photoreceptor and a process for producing the same. More particularly, it relates to an electrophotographic photoreceptor having a light reflection-preventing layer and to a process for producing the same.

BACKGROUND OF THE INVENTION

An electrophotographic photoreceptor has recently found its use in apparatus utilizing electrophotographic process, such as a laser beam printer using monochromatic light, and various photoreceptors suitable for that use have been proposed. For example, so-far proposed electrophotographic photoreceptors sensitive to the long wavelength region include those having a photosensitive layer containing a phthalocyanine pigment, e.g., copper phthalocyanine, and particularly those having photosensitive layers of function separated type which are composed of a charge generating layer and a charge transporting layer; and those having a photosensitive layer comprising a selenium-tellurium alloy. When such a photoreceptor sensitive to the long wavelength region is fixed to a laser beam printer, and light exposure is conducted by scanning with a laser beam, an interference fringe emerges into a developed toner image, and a satisfactory reproduced image cannot be obtained. One of the causes of the interference fringe is that a long wavelength laser beam is not completely absorbed by a photosensitive layer and the transmitted light is regularly reflected on the surface of a substrate to cause multiple reflection within the photosensitive layer, which results in interference between the surface of the photosensitive layer and the reflected light.

In order to eliminate this disadvantage, it has been proposed to roughen the surface of a conductive substrate as described in JP-A-60-168156 and JP-A-60-177357 (the term "JP-A" as used herein means an "unexamined published Japanese patent application") or to provide a light absorbing layer or a reflection-preventing layer between a photosensitive layer and a substrate as described in JP-A-58-187936 and JP-A-58-87937 to prevent multiple reflection within a photosensitive layer.

However, none of the conventionally proposed means actually succeeded to completely eliminate an interference fringe appearing on the image. It has therefore been demanded to develop a reflection-preventing layer which eliminates the problem of an interference fringe.

SUMMARY OF THE INVENTION

Accordingly, one object of the present invention is to provide an electrophotographic photoreceptor which provides an image having satisfactory quality while preventing appearance of an interference fringe when applied to a laser beam printer.

Another object of the present invention is to provide a process for producing the above-described electrophotographic photoreceptor.

The inventors found that an anodized aluminum film formed on a substrate comprising aluminum or an aluminum alloy has a function of preventing light reflection and thus completed the present invention.

The present invention relates to an electrophotographic photoreceptor comprising a substrate having thereon a light reflection-preventing layer comprising an anodized aluminum film and a photosensitive layer in this order.

The electrophotographic photoreceptor of the present invention can be produced by a process comprising subjecting a substrate at least a surface of which comprises aluminum or an aluminum alloy to anodic oxidation in a neutral aqueous solution containing at least one of boric acid, boric acid salt, a phosphoric acid salt, etc. in a concentration of from 1 to 30% by weight or an acidic aqueous solution containing at least one of sulfuric acid, phosphoric acid, oxalic acid, chromic acid, etc. in a concentration of from 1 to 30% by weight to form an anodized aluminum film as a light reflection-preventing layer on the substrate, and then forming a photosensitive layer on said anodized aluminum film.

BRIEF DESCRIPTION OF THE DRAWING

The drawing FIGURE illustrates a schematic cross section of an embodiment of the electrophotographic photoreceptor according to the present invention, in which numeral 1 is a substrate, 2 is a light reflection-preventing layer comprising an anodized aluminum film, and 3 is a photosensitive layer.

DETAILED DESCRIPTION OF THE INVENTION

The drawing FIGURE is a schematic cross section of the electrophotographic photoreceptor according to the present invention which comprises substrate 1, light reflection-preventing layer comprising an anodized aluminum film 2 formed on substrate 1, and photosensitive layer 3 formed on light reflection-preventing layer 2.

The substrate which can be used in the present invention includes an aluminum or aluminum alloy substrate preferably having a thickness of at least 5 μm (particularly at least 20 μm, and (hereinafter inclusively referred to as an aluminum substrate), other conductive substrates, and insulating substrates. In using a substrate other than an aluminum substrate, it is preferred to form an aluminum film having a thickness of at least 5 μm (particularly at least 20 μm) on the substrate at least over an area contacting the other layer. The aluminum film can be formed by vacuum evaporation, sputtering, or ion plating. Conductive substrates other than an aluminum substrate include metals, e.g., stainless steel, nickel, chromium, etc., and alloys thereof. Insulating substrates include films or sheets of high polymers, e.g., polyester, polyethylene, polycarbonate, polystyrene, polyamide, polyimide, etc., glass, and ceramics.

An aluminum material for obtaining an anodized aluminum film having satisfactory characteristics is properly chosen from among pure aluminum and aluminum alloy materials, such as Al-Mg, Al-Mg-Si, Al-Mg-Mn, Al-Mn, Al-Cu-Mg, Al-Cu-Ni, Al-Cu, Al-Si, Al-Cu-Zn, Al-Cu-Si, Al-Cu-Mg-Zn, and Al-Mg-Zn. Among these aluminum materials, Al-Mg and Al-Mn are preferred.

The anodized aluminum film formed on the aluminum surface of the substrate plays a roll as a light reflection-preventing layer.

The anodized aluminum film is formed on the substrate by anodic oxidation as follows. A substrate with an aluminum surface having been polished to have a mirror finish and cut to a desired size is subjected to ultrasonic cleaning in an organic solvent or a flon (i.e., Freon) solvent and then in pure water. After the cleaning treatment, the aluminum surface of the substrate may be subjected to a pretreatment, such as boiling in pure water or steaming. Such a pretreatment brings about favorable results in reducing a quantity of electricity required for anodic oxidation or improving film properties.

An electrolytic solution is filled in an electrolytic cell made of stainless steel, hard glass, etc. to a prescribed level. The electrolytic solution which can be used is a 1 to 30% by weight (preferably a 5 to 25% by weight) neutral aqueous solution of at least one of boric acid, a boric acid salt, a phosphoric acid salt, etc.; or a 1 to 30% by weight (preferably a 5 to 25% by weight) acidic aqueous solution of at least one of sulfuric acid, phosphoric acid, oxalic acid, chromic acid, etc. Among these, neutral or acidic aqueous solutions of boric acid, a boric acid salt, sulfuric acid or oxalic acid are preferred. Pure water to be used as a solvent includes distilled water and ion-exchanged water. In order to prevent corrosion of the anodized aluminum film or production of pinholes, it is particularly preferred to remove impurities, e.g., chlorine, from the water.

Then, the substrate having an aluminum surface and a stainless steel plate or an aluminum plate are immersed in the electrolytic solution as an anode and a cathode, respectively, with a given electrode gap therebetween. The electrode gap is appropriately selected from 0.1 to 100 cm. A direct current power source is prepared, and its positive (plus) terminal is connected to the aluminum surface of the substrate, with the negative (minus) terminal connected to the cathode plate, and electricity is passed through the both electrodes in the electrolytic solution. Electrolysis is carried out by a constant current method or a constant voltage method. The direct current applied may consist solely of a direct current component or may comprise a combination of a direct current and an alternating current. The current density in carrying out anodic oxidation is set usually between 0.1 $A.dm^{-2}$ and 10 $A.dm^{-2}$ and preferably between 1 $A.dm^{-2}$ and 6 $A.dm^{-2}$. The anodizing voltage usually ranges from 1 to 700 V, and preferably from 10 to 300 V. The electrolytic solution has a temperature of usually from −5° to 100° C. and preferably from 10° to 80° C.

By electrolysis under these conditions, there is formed an anodized aluminum film on the aluminum surface of the substrate (anode). When a neutral aqueous solution containing boric acid, a boric acid salt, a phosphoric acid salt, etc. is used as an electrolytic solution, the resulting anodized aluminum film is non-porous, while in using an acidic aqueous solution containing sulfuric acid, phosphoric acid, oxalic acid, chromic acid, etc., the film becomes porous.

If desired, the thus formed anodized aluminum film may be washed with pure water, followed by drying. The anodized aluminum film has a thickness of usually from 0.01 to 0.7 μm (preferably from 0.05 to 0.5 μm) in the case of a non-porous film, and usually from 1 to 20 μm (preferably from 2 to 10 μm) in the case of a porous film.

Particularly, in this invention, the non-porous anodized aluminum film is preferred. The non-porous anodized aluminum film has particularly preferably a thickness of from 0.15 to 0.7 μm. The non-porous anodized aluminum film is preferably formed at an anodizing voltage of 10 V or more using the neutral aqueous solution.

On the thus prepared anodized aluminum film, a photosensitive layer is directly formed with intimate contact. A photosensitive layer may have a single layer structure or a laminate structure composed of a charge generating layer and a charge transporting layer. The photosensitive layer has a thickness of from 10 to 100 μm.

The photosensitive layer includes a layer of an inorganic substance, e.g., amorphous silicon, selenium, selenium hydride, and selenium-tellurium, formed by plasma CVD, vacuum evaporation, sputtering or the like technique. Additionally included in the photosensitive layer is a layer formed by vacuum evaporation of a dye, e.g., phthalocyanine, copper phthalocyanine, Alphthalocyanine, squaric acid derivatives, and bisazo dyes, or by dip coating of a dispersion of such a dye in a resin. Inter alia, a photosensitive layer formed of amorphous silicon or germanium-doped amorphous silicon exhibits excellent mechanical and electrical characteristics.

A case where a photosensitive layer is formed by using amorphous silicon is instanced in illustration.

A photosensitive layer mainly comprising amorphous silicon can be formed by a process appropriately selected according to the purpose from among known techniques, such as glow discharge decomposition, sputtering, ion plating, and vacuum evaporation. Glow discharge decomposition of silane or a silane type gas by plasma CVD is preferred. According to the process, a film containing an adequate amount of hydrogen which has relatively high dark resistance and high photosensitivity and thus exhibits favorable characteristics as a photosensitive layer can be formed.

A plasma CVD method will be illustrated below.

Raw materials for forming an amorphous silicon photosensitive layer mainly comprising silicon include silanes, e.g., monosilane and disilane. In the formation of a photosensitive layer, a carrier gas, e.g., hydrogen, helium, argon, and neon, may be used, if desired. These starting gases may be doped with diborane ($B_2H_6$), phosphine ($PH_3$) etc. to form a layer containing an impurity element, e.g., boron, phosphorus, etc. For the purpose of increasing photosensitivity, etc., the photosensitive layer may further contain a halogen atom, a carbon atom, an oxygen atom, a nitrogen atom, etc. For the purpose of increasing sensitivity to a longer wavelength region, the layer may furthermore contain germanium, tin, etc.

The photosensitive layer which can be preferably used in the present invention mainly comprises silicon and contains from 1 to 40 at.%, and particularly from 5 to 20 at.%, of hydrogen. In this case, the thickness of the photosensitive layer is in the range of usually from 1 to 50 μm, and preferably of from 5 to 30 μm.

Conditions of forming a photosensitive layer are usually from 0 to 5 GHz, preferably from 3 to 5 GHz, in frequency; usually from $1\times10^{-5}$ to 5 Torr (0.001 to 665 Pa), preferably from $1\times10^{-1}$ to 3 Torr in degree of vacuum on discharging; and usually from 100° to 400° C., preferably from 150° to 300° C. in substrate heating temperature.

If desired, the electrophotographic photoreceptor of the present invention may have a surface protective layer for preventing alteration due to corona ion.

The present invention is now illustrated in greater detail with reference to Examples, but it should be understood that the present invention is not deemed to be limited thereto.

EXAMPLE 1

An aluminum pipe (diameter: about 120 mm) made of an aluminum alloy containing 4 wt% Mg was cleaned with flon (i.e., freon) and then with ultrasonic waves in distilled water and treated in boiling pure water for 15 minutes to form a substrate. Subsequently, the aluminum pipe was subjected to anodic oxidation in an aqueous solution containing 10 wt% of boric acid and 1 wt% of borax kept at 80° C. by applying a direct voltage of 50 V between the aluminum pipe and a cylindrical cathode of a stainless steel plate at a current density of 0.2 $A.dm^{-2}$ for 30 minutes to form a 0.07 μm thick barrier-type anodized aluminum film.

The aluminum pipe having a light reflection-preventing layer comprising the anodized aluminum film was subjected to ultrasonic cleaning in distilled water, dried at 80° C., and placed in a vacuum chamber of a capacitively-coupled type plasma CVD apparatus. The aluminum pipe being maintained at 200° C., 100 wt% silane gas ($SiH_4$), hydrogen-diluted 100 ppm diborane gas ($B_2H_6$), and 100 wt% hydrogen gas ($H_2$) were introduced therein at a rate of 250 ml/min, 3 ml/min, and 250 ml/min, respectively. After the inner pressure of the vacuum chamber was set at 1.5 Torr (200.0 $N/m^2$), a high-frequency electric power of 13.56 MHz was applied to cause glow discharge, and the output of the high-frequency power source was maintained at 350 W. There was thus formed a 18 μm thick photosensitive layer having high dark resistance, comprising so-called i-type amorphous silicon and containing hydrogen and a trace amount of boron.

Positive chargeability of the resulting photoreceptor was measured. When an electric current of 10 μA/cm was passed through the photoreceptor, the initial surface potential immediately after charging was 630 V, and the dark decay rate was 14%/sec. The residual potential after exposure to white light was 20 V, and the half-decay exposure amount (i.e., exposure required for the half decay of the surface potential) was 10 $erg.cm^{-2}$. The surface reflectance of the photoreceptor at 780 nm was 11%.

Adhesion between the photosensitive layer and the anodized aluminum film was satisfactory.

EXAMPLE 2

The same aluminum pipe as used in Example 1 was cleaned with flon (i.e., freon) and then ultrasonic waves in distilled water. The aluminum pipe was then subjected to anodic oxidation in an aqueous solution containing 12 wt% of sulfuric acid and 0.5 wt% of aluminum sulfate kept at 25° C. by applying a direct voltage of 12 V between the aluminum pipe and a cylindrical cathode of a stainless steel plate at a current density of 1.8 $A.dm^{-2}$ for 20 minutes to form a 8 μm thick anodized aluminum film.

After the aluminum pipe having an anodizied aluminum film was cleaned by ultrasonic waves in distilled water, followed by drying, a photosensitive layer was formed thereon in the same manner as in Example 1. The resulting electrophotographic photoreceptor was evaluated in the same manner as in Example 1. The results obtained are shown below.

Initial Surface Potential: 750 V
Dark Decay Rate: 13%/sec
Residual Potential: 50 V
Half Decay Exposure Amount: 11 $erg.cm^{-2}$
Surface Reflectance at 780 nm: 8%

Adhesion between the photosensitive layer and the anodized aluminum film was proved satisfactory.

COMPARATIVE EXAMPLE 1

An electrophotographic photoreceptor was prepared in the same manner as in Example 1, except that anodic oxidation of the aluminum substrate was not conducted.

The resulting photoreceptor was evaluated in the same manner as in Example 1. As a result, the surface reflectance at 780 nm was found to be 65%. The adhesion between the photosensitive layer and the substrate was insufficient, and when the photoreceptor was allowed to stand for 10 days, the photosensitive layer was partially peeled apart.

As described above, the electrophotographic photoreceptor according to the present invention having an anodized aluminum film as a light reflection-preventing layer, on which a photosensitive layer is formed, provides an image of satisfactory quality while preventing appearance of an interference fringe when applied to a laser beam printer.

While the invention has been described in detail and with reference to specific embodiments thereof, it will be apparent to one skilled in the art that various changes and modifications can be made therein without departing from the spirit and scope thereof.

What is claimed is:

1. An electrophotographic photoreceptor comprising a substrate having thereon a light reflection-preventing layer consisting essentially of an anodized aluminum film which is non-porous throughout its entire thickness and a photosensitive layer in this order.

2. A process for producing an electrophotographic photoreceptor which comprises subjecting a substrate at least a surface of which consisting essentially of aluminum or an aluminum alloy to anodic oxidation in a neutral aqueous solution containing at least one of boric acid, boric acid salt, and a phosphoric acid salt in a concentration of from 1 to 30% by weight or an acid aqueous solution containing at least one of sulfuric acid, phosphoric acid, oxalic acid, and chromic acid in a concentration of from 1 to 30% by weight to form an anodized aluminum film which is non-pourous throughout its entire thickness as a light reflection-preventing layer on the substrate, and then forming a photosensitive layer on said anodized aluminum film.

3. The electrophotographic photoreceptor as claimed in claim 1, wherein said photosensitive layer is formed by using amorphous silicon.

4. The process for producing an electrophotographic photoreceptor as claimed in claim 2, wherein said photosensitive layer is formed by using amorphous silicon.

5. The electrophotographic photoreceptor as claimed in claim 1, wherein said anodized aluminum film has a thickness of from 0.15 to 0.7 μm.

6. The process for producing an electrophotographic photoreceptor as claimed in claim 2, wherein said anodized aluminum film has a thickness of from 0.15 to 0.7 μm.

7. The process for producing an electrophotographic photoreceptor as claimed in claim 2, wherein said concentration for the neutral or acid aqueous solution is from 5 to 25% by weight.

8. The electrophotographic photoreceptor as claimed in claim 1, further comprising a hydrated aluminum oxide film intermediate said light reflection preventing layer and said photosensitive layer.

9. The process for producing an electrophotographic photoreceptor as claimed in claim 2, wherein said substrate is subjected to heated-water or steam before said substrate is anodized.

* * * * *